US005657866A

United States Patent [19]

Kaneko et al.

[11] Patent Number: 5,657,866

[45] Date of Patent: Aug. 19, 1997

[54] PACKAGE FOR PREVENTING CAKING OF POWDERS AND GRANULES

[75] Inventors: Toyokazu Kaneko, Kawasaki; Koji Igarashi, Saga-ken; Terumi Watanabe, Kawasaki; Shinichi Matsumoto, Kawasaki; Shigenobu Harano, Kawasaki, all of Japan

[73] Assignee: Ajinomoto Co., Inc., Tokyo, Japan

[21] Appl. No.: 576,562

[22] Filed: Dec. 21, 1995

[30] Foreign Application Priority Data

Dec. 26, 1994 [JP] Japan ..... 6-321126
Nov. 21, 1995 [JP] Japan ..... 7-302858

[51] Int. Cl.[6] ..... B65D 81/24

[52] U.S. Cl. ..... 206/204; 206/205; 206/524.1; 383/113; 53/478

[58] Field of Search ..... 206/204, 205, 206/524.1, 524.2, 524.4; 383/109, 111, 113; 53/400, 431, 478

[56] References Cited

U.S. PATENT DOCUMENTS 3,084,984 4/1963 Adler ..... 206/204
4,861,632 8/1989 Caggiano ..... 206/204
4,927,010 5/1990 Kannankeril ..... 206/204
5,241,149 8/1993 Watanabe et al. ..... 206/204
5,267,646 12/1993 Inoue et al. ..... 206/204
5,372,429 12/1994 Beaver, Jr. et al. ..... 206/524.4
5,480,693 1/1996 Patterson et al. ..... 206/204

FOREIGN PATENT DOCUMENTS 0513 364 11/1992 European Pat. Off. .

*Primary Examiner*—Paul T. Sewell
*Assistant Examiner*—Luan K. Bui
*Attorney, Agent, or Firm*—Oblon, Spivak, McClelland, Maier & Neustadt, P.C.

[57] ABSTRACT

The present invention relates to a double packages for preventing caking of powders or granules which comprises an inner container having high water vapor permeability for packaging article, an outer container having no or low water vapor permeability for packing said inner container, and desiccants placed between said inner container and said outer container.

8 Claims, 2 Drawing Sheets

PACKAGE FOR PREVENTING CAKING OF POWDERS AND GRANULES

BACKGROUND OF THE INVENTION

The present invention relates to packages having caking preventing function which is suitable for use for powders or granules having caking property by the effect of water and containing a very small amount of water.

Among amino acids, threonine, arginine hydrochloride, lysine hydrochloride etc. cake easily. Even when these amino acids are packed in a plastic bag for storage, in extreme cases they may cake so that the total contents become as hard as stone. Therefore, extreme care has been taken to prevent them from caking.

Hitherto, there has been employed a double packing bag wherein both an inner and an outer bags have no or extremely low water vapor permeability and desiccants such as silica gel and the like are placed between the inner and outer bags in order to prevent completely the entry of moisture into the packaged article from the outside. However, even though packed in such double bag, the total contents in the inner bags may cake and form hard lumps while in storage for a long-term over one year. In some cases, the contents cake in several months' storage.

As the caking inhibiting means for L-lysine hydrochloride, a process was developed for changing L-Lysine hydrochloride dihydrate into α-form crystals of anhydrous, L-Lysine hydrochloride at a temperature of 115° C. or higher and then packaging in a bag as disclosed in Japanese KOKAI Publication No. 45145/1982. However, this process is not widely applicable as the caking preventing means but a particular improvement in the caking property of L-lysine hydrochloride alone.

In addition to amino acids, inorganic salts such as ammonium nitrate and the like have encountered the similar caking problem. The improvements were to coat the particle surface with wax or other surface covering agent. In this process, however, the lowering in the purity of the products is unavoidable.

Furthermore, in order to prevent the caking of powders or granules of hygroscopic food products during the preservation, desiccants such as silica gel etc. have directly been placed with articles in the container. However, this process has a disadvantage that the packaged articles suffers a danger of contamination with the drying agents of desiccants. Therefore, it is not suitable for the package of pharmaceuticals in bulk and of the raw materials for manufacturing pharmaceuticals such as amino acids for transfusion which high purity is required.

SUMMARY OF THE INVENTION

An object of the present invention is to provide a package by which the caking problems of powders and granules which occur while in storage can be fundamentally solved without lowering in the purity of the products.

Double packages suitable for use for powders or granules which exhibit a tendency to lose free flowing properties and cake or form lumps by the effect of water while in storage is disclosed herein.

In a double package for powders or granules composed of an inner container for packaging article and an outer container for packing said inner package, the double package comprising said inner package having high water vapor permeability, said outer package having no or low water vapor permeability, and desiccant placed between said inner and outer containers.

DETAILED DESCRIPTION OF THE INVENTION

Figure 1:
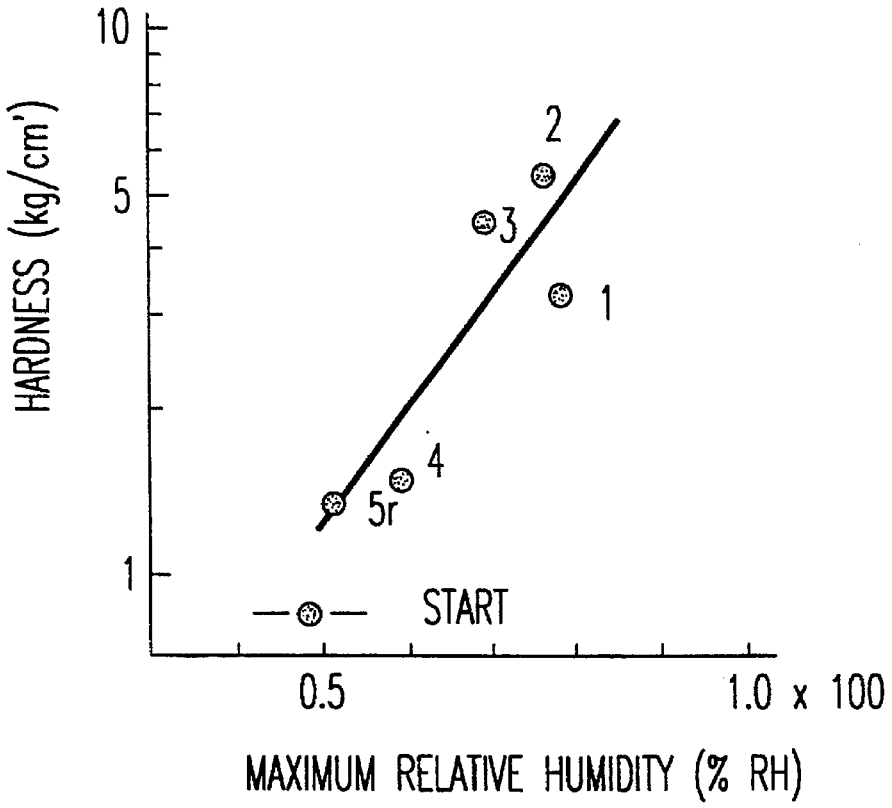
FIG. 1 is a graph showing a result of measurement of the relation between the maximum relative humidity attained in the inner bags, and the hardness of L-threonine crystals stored for one year in using various inner bags having different water vapor permeabilities.

We have considered that the powders or granules packed in the prior art double package would cake for storage probably based on the following mechanisms. A very small amount of water is present on the surface of the particles and then the surface part of the particles dissolves in the water. Upon evaporation of the water of contact parts of the particles, the dissolved substance precipitates and acts as adhesive agent for binding of the particles to cause caking.

Furthermore, a series of experiments have been made:

(1) When powders were packed in the hermetic container having no or low water vapor permeability together with the desiccants and storaged, certainly any caking did not occur.

(2) When all of the deskcants were removed from the bag at the interval of storage term and the re-hermetic container was continued to storage in the absence of the desiccants, then caking occurred.

(3) In this case, we have found that the relative humidity inside the inner container at that time increased in comparison with that measured when the desiccants were removed.

It has been considered that a very small amount of water is contained in the particles and it migrates to the particle surface with passage of time to cause caking.

Although care has been hitherto taken toward the entry of moisture through the packaging material from the outside, it is impossible to prevent caking with the prior art packages. For preventing caking, it is necessary to remove water quickly which migrates to the particle surface from the inside of them with passage of time as above-stated and forms the aqueous membrane growing to be thick layer enough to dissolve the surface of particles by keeping low humidity in the inner container.

We have successed in the development of the package which can achieve the object of the present invention based on the above findings.

That is, the present invention relates to a double package for powders or granules, said double package comprises an inner container having water vapor permeability for packing powders or granules and an outer container having no or low water vapor permeability for packing said inner container, and desiccants placed between said inner and outer containers.

The caking is affected by the relationship between humidity and solubility of the packed article at storage temperature and in addition by contact area between particles of powders or granules (the shape and the size of the particles). Therefore, if the packed article and the storage temperature are fixed, the upper limit of no caking humidity may be determined e.g. by the following simple method.

Each of dishes filled with a saturated solution of various inorganic salts is placed in a desiccater where dry article is placed in a other dish. The relative humidity is kept at constant level by the effect of saturated solution and the caking state of article is observed to estimate an approximate no caking humidity.

Therefore, the water vapor permeability of the inner container, the kind and amount of the desiccant may be selected so that the humidity in the inner container can be kept less than the upper limit. The water vapor permeability herein indicates value measured at 40° C. and 90% relative humidity (RH) difference according to JIS K 7129.

The inner container of the present invention is characterized by high water vapor permeability and it is more desirable that it is higher. The lower limit of the water vapor permeability for the inner container differs depending on the kind of packed article and the storage conditions such as storage temperature. The inner container may be selected suitable water vapor permeability so that the article packed in it does not cake during the stored time. For example, for the purpose of packing 50 kg of powders or granules in an inner gag having total surface area of 2 $m^2$, the water vapor permeability of the inner bag is 400 $g/m^2$.24 hrs. or more, preferably 1000 $g/m^2$.24 hrs. or more and more preferably 1500 $g/m^2$.24 hrs. or more. For example, in the case that crystals of L-lysine acetate is storaged at room temperature, the water vapor permeability of 500 $g/m^2$.24 hrs. or more is preferred. The upper limit of water vapor permeability dosen't exist in particular, but it is restricted rather from the close property of no spilling powder or granule through the inner container, and no breaking strength.

The needed water vapor permeability may be an average value of the inner container in its entirety. So the inner container may be close-fitting complex of packaging material having extremely high water vapor permeability and having no or low water vapour permeability.

The preferred examples of packaging material for the inner container include non-woven fabric made of polyethylene, polypropylene, polystyrene, polyurethane, polyamide, cellulose and the like, various plastic films or sheets (such as cellophane, nylone-12, nylone-6, nylone-6,6, polyvinyl alcohol, cellulose acetate etc.), various perforated films or sheets having micropores, films or sheets containing inorganic salt (such as polypropylene film containing magnecium carbonate) paper, woven fabric and the like.

The shape of the inner container may be various bags such as flat bags and gusset bags. It may also be rigid container such as box, can, drum and the like.

Preventing the entry of moisture into the double package from outside, the outer container should be characterized by no or low water vapor permeability of 10 $g/m^2$.24 hrs. or less, preferably 2 $g/m^2$.24 hrs. or less, and more preferably 0.1 $g/m^2$.24 hrs. or less.

Examples of such packaging materials include various plastic films or sheets such as low density polyethylene, high density polyethylene, polyvinylidene chloride, polyethylene telephthalate and polypropylene and the like. Also, these may be films or sheets laminated silica coated ones, altminium coated ones, alumina coated ones, metal foils. And metals are included, too.

The outer container may also be in the shape of various bags, box, can, drum etc.

Also, the inner containers may be partially jointed to the outer container by heat-sealing, gluing and the like to form one united package.

The desiccant for preventing caking of the powders or granules are ones which are capable of absorbing water which is contained in the inside of the powders or granules and which generates gradually therefrom and passes through the inner container. Examples of the desiccants include silica gel, dry calcium chloride, calcium oxide, water absorbing polymers (such as sodium acrylic resin etc.), minerals (such as sodium calcium aluminosilicate hydrated clays etc.). A moisture permeable pouch put in by moisture absorbing agents, above is the most suitable as the shape of a desiccant, but other shapes can also be used in case of no possibility contaminated in the packed article. Also, the inner packaging material itself may be one having hygroscopic property.

The kind and amount of the desiccant is selected so that the humidity in the inner container can be maintained to no caking level. Usually silica get or dry calcium chloride may be used in an amount of 0.5 to 5% by weight based on the amount packed of powders or granules.

The packaged articles are powders and granules having the possibility of losing their free flowing property and caking or forming lumps white in storage by the effect of a very small amount of water in their particles. In general, they may be obtained by crystallizing out from an aqueous solution, spray drying of an aqueous solution or pulverizing the dried solid.

Amino acids to which the package of the present invention may be conveniently applied are threonine, arginine hydrochloride, lysine hydrochloride, lysine acetate, taurine, ornithine hydrochloride, setinc, glutamine, proline etc. (in anhydride, respectively). They may be mixtures. In the case of crystalline amino acids, the caking preventing effect may be achieved by maintaining the humidity in the inner container to 20% RH or less for α- form of lysine hydrochloride, to 30% RH or less for β- form of lysine hydrochloride, lysine acetate or arginine hydrochloride, to 40% RH or less for alanine or threonine, to 50% RH or less for serine, respectively.

The package of the present invention may be applied to all kinds of powders and granules containing a very small amount of water, including the case where the entry of water from the environment under: the packaging operation causes caking.

Thus, the package of the present invention may be widely applied to water-soluble powders or granules particularly demanded purity, other than amino acids. Examples of such products include an artificial or natural flavoring matters, pharmaceuticals in bulk, raw materials for manufacturing pharmaceuticals, vitamins (such as vitamin C etc.) inorganic salts (such as sodium chloride, sodium nitrate, ammonium sulfate etc.)

Whether or not the package of the present invention is effective for powders or granules to be packed therein can be judged by measurement of the humidity change. For this purpose, sample immediately after drying is placed in a hermetical vessel setting a temperature and humidity sensor and the change in humidity in the closed vessel is measured continuously. If the humidity increases with passage of time, then this shows that water has migrated to the particle surface from the inside to form aqueous membrane thereon. Therefore, the package of the present invention may be conveniently applied to articles showing such a humidity increase, since it is considered that they would cake when packed in the ordinary package. Of course, the package of the present invention is also effective for the cases where moisture carried from the environment during packaging operation causes the caking problem.

In the packaging process with the package of the present invention, the inner and outer containers may be conducted according to the respective processes. In the case that they are in the shape of-bag, the opening part of the bag is closed by heat-sealing, gluing or clipping with string or rubber bands etc. the opening edge of the outer container may be added fold or twist wrapping moreover. In the case of box, can or drum, in general the opening part of them is closed with a lid. A seal tape may be applied to the connections between the lid and the container for protection if necessary. Of course, a plural number of inner containers may be packaged in an outer container.

Desiccants may be placed at the upper, lower and side parts outside the inner containers. They may be placed at one side collectively but it is preferable to place them all around the outside of the inner containers.

In the package of the present invention, the water vapor permeability of the inner container is extremely large so that water which migrates to the particle surface from its inside with passage of time is removed by evaporation before an aqueous membrane formed on the particle surface grows sufficient thick layer to dissolve the surface. That is, in the package of the present invention composed of the outer container made of water vapor no or less permeable package material and the inner container made of water vapor much more permeable package material, the desiccants being placed between the outer and the inner container, the desiccants absorb the moisture permeated through the inner container in extremely high rate in comparison with the rate of the humidity increase in the inner container by the moisture generated from the packed articles inside. As a consequence, the humidity in the inner container may be controlled at lower level and be prevented losing their free flowing properties and caking or forming lumps while in storage.

According to the present invention, even in the case of L-lysine hydrochloride which involves in the conversion of crystal form, the crystal conversion and the caking can be inhibited by controlling the humidity in the inner container below 20% RH at room temperature.

EXAMPLES

EXAMPLE 1

Fifty kg of crystals of L-threonine (a product of Ajinomoto Co., Inc. loss on drying (for 3 hours at 105° C.); 0.03% by weight) was placed in each of five inner bags made of the packaging material having a different water vapor permeability, and the opening parts of the respective inner bags were clipped securely with a string.

Each of the inner bags was placed in an outer bag made of an aluminium foil laminated film (PET/PE/AI/PE/L-LDPE)

Note: PE represents polyethylene adhesive layer Al represents aluminum foil having very low water vapor permeability (≦0.1 g/m$^2$.24 hrs.) and 90 μm in total thickness and then 500 g of silica gel was inserted between the inner and the outer bags. The opening part of the respective outer bags was heat-sealed and each of the outer bags was placed in a fiber drum. The fiber drum was capped and storaged in an ordinary warehouse without an air conditioning system for a year.

The packing conditions during the storage were shown in Table 1. The relation between the maximum relative humidity attained in the inner bags during the storage and the caking extent of the contents therein after the storage was investigated.

Figure 2:
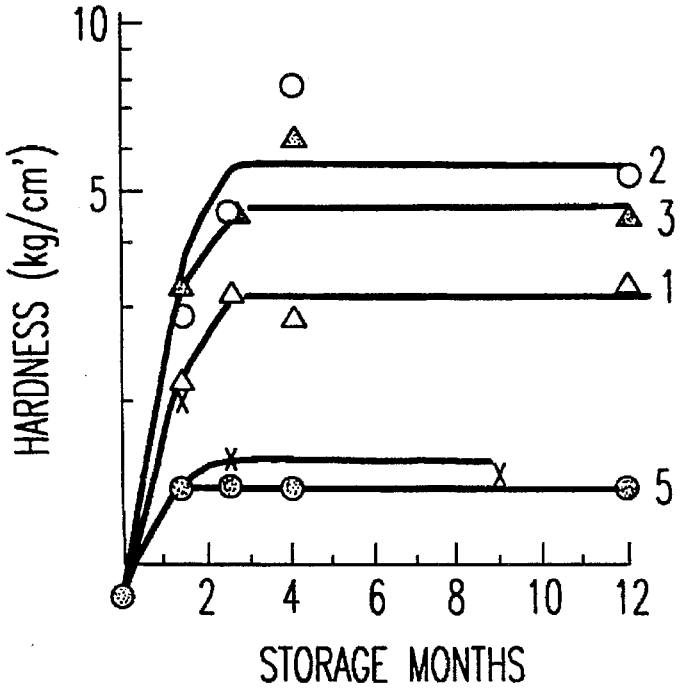
FIG. 2 is a graph showing a result of measurement of the relation between the storage months and the hardness of the L-threonine crystals in using various inner bags having different water vapor permeabilities.

As a result, the relation between the maximum relative humidity attained in the inner bag and the hardness of the crystals representing the caking extent was as shown in FIGS. 1 and 2. The hardness of the crystals was measured using an improved apparatus of the hardness meter for fruits. That is, a sharp-pointed needle having 4 mm in diameter was slowly sticked vertically into the crystals and the required pressure (kg/cm$^2$) at that time was read from the gauge.

The water vapor permeability of the packaging materials was measured at 40° C. and 90% relative humidity (RH) difference according to JIS K 7129.

The crystals in Exp. Nos. 1, 2 and 3 caked so that the total contents became a hard lump, while the crystals in Exp. Nos. 4 and 5 did not cake at all and were free flowing as before storage.

TABLE 1

<Packing conditions>

| | Water Vapor Permeability of Packaging Material (g/m$^2$ · 24 hrs.) | | Ratio of Silica Gel to the Crystals | Amount Packed of the Crystals |
|---|---|---|---|---|
| Exp. No. | Outer Bag | Inner Bag | (%) | (kg) |
| 1 | ≦0.1 | 7 | 1 | 50 |
| 2 | ≦0.1 | 19 | 1 | 50 |
| 3 | ≦0.1 | 140 | 1 | 50 |
| 4 | ≦0.1 | 3100 | 1 | 50 |
| 5 | ≦0.1 | — | 1 | 50 |

The inner bags of Exp. Nos. 1 to 5 were made of the following packaging materials:

Exp. No. 1: Low density polyethylene film 80 μm in thickness

Exp. No. 2: Low density polyethylene film 30 μm in thickness

Exp. No. 3: Polyvinyl alcohol based film 65 μm in thickness

Exp. No. 4: Perforated film ("Cellpore WN-07"; a product of Sekisui Chemical Industry Co., Ltd.) 170 μm in thickness Exp. No. 5: Nothing

EXAMPLE 2

Fifty kg of crystals of L-arginine hydrochloride (a product of Ajinomoto Co., Inc., loss on drying; 0.04% by weight) was packed in a bag under the conditions shown in Table 2 and storaged for 6 months under similar conditions as in Example 1.

The relation between the maximum relative humidity attained in the inner bag during the storage and the caking extent of the crystals after the storage was estimated.

Figure 3:
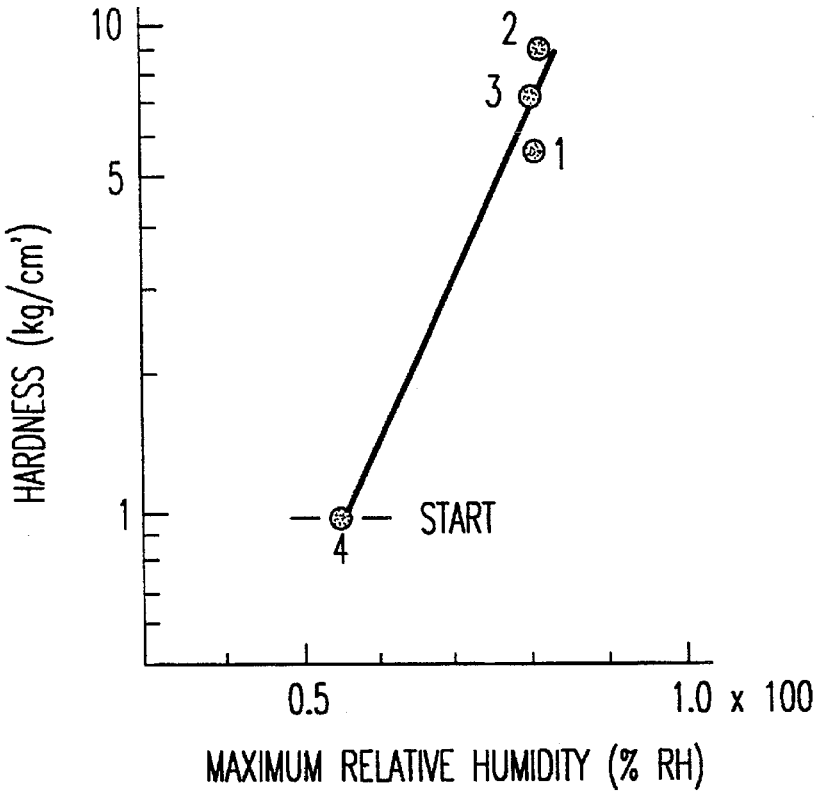
FIG. 3 is a graph showing a result of measurement of the relation between the maximum relative humidity attained in the inner bags and the hardness of the L-arginine hydrochloride crystals stored for six months, in using various inner bags having different water vapor permeabilities.

As a result, the relation between the maximum relative humidity attained and the hardness of the crystals representing the caking extent was as shown in FIG. 3.

TABLE 2

<Packing conditions>

| Exp. No. | Water Vapor Permeability of Packaging Material ($g/m^2 \cdot 24$ hrs.) Outer Bag | Inner Bag | Ratio of Silica Gel to the Crystals (%) | Amount Packed of the Crystals (kg) |
|---|---|---|---|---|
| 1 | 2 | 7 | 0.6 | 50 |
| 2 | 2 | 269 | 0.6 | 50 |
| 3 | 2 | 470 | 0.6 | 50 |
| 4 | 2 | 3100 | 0.6 | 50 |

An outer bag: silica coated polyethylene telephthalate (PET)/linear low density polyethylene (L-LDPE) 85 μm in total thickness (moisture permeability of 2 $g/m^2$.24 hrs.)

An inner bag:

Exp. No. 1: Low density polyethylene film 80 μm in thickness

Exp. No. 2: Polyvinyl alcohol based film 30 μm in thickness

Exp. No. 3: Complex film of "Cellpore WN-07" (15% of total area) and cast polypropylene (85% of total area; 50 μm in thickness Exp. No. 4: Perforated film "Cellpore WN-07" 170 μm in thickness The crystals in Exp. Nos. 1, 2 and 3 caked so that the whole contents became a hard lump while the crystals in Exp. No. 4 did not cake and the whole contents were free flowing as before storage. That is, it is evident that the tendency of crystals to cake and form lumps while in storage may be remarkably reduced by making the water vapor permeability of the inner bag greater and controlling the maximum relative humidity attained therein at low level.

EXAMPLE 3

Crystals of L-lysine hydrochloride (a product of Ajinomoto Co., Inc., loss on drying; 0.15% by weight) was packed in a bag under the following condition and storaged for a year under similar condition as in Example 1.

As a result, the relation between the conversion of crystal form and the caking after the storage was as shown in Table 3.

Packing condition

① An inner bag having low water vapor permeability

An outer packaging drum: fiber drum

An outer bag (very low water vapor permeability (≦0.1 $g/m^2$.24 hrs.)): an aluminum foil laminated film (PET/PE/Al/PE/L-LDPE) 90 μm in total thickness An inner bag having low water vapor permeability: Low density polyethylene film 80 μm in thickness) 7 $g/m^2$.24 hrs An amount used of silica gel: 500 g (1% based on the amount of the crystals)

An amount packed of the crystals: 50 kg

② An inner bag having large water vapor permeability

An outer packaging drum: fiber drum

An outer bag (very low water vapor permeability (≦0.1 $g/m^2$.24 hrs.))): An aluminum laminated film (PET/PE/Al/PE/L-LDPE) 90 μm in total thickness An inner bag having large water vapor permeability: 3100 $g/m^2$.24 hrs. Perforated film "cellpore WN-07", 170 μm in thickness An amount used of silica gel: 500 g (1% based on the amount of the crystals)

An amount packed of the crystals: 50 kg

TABLE 3

<Result>

| | Crystal Form When Started for Storage | After Storage for A year | Caking State After Storage for A Year | Relative Humidity in the Inner Bag After Storage for A Year |
|---|---|---|---|---|
| ① Low Moisture - Permeable Inner Bag | α | β | Hard and Compacted State | 39% |
| ② Large Moisture - Permeable Inner Bag | α | α | Free Flowing State | 18% |

In the packaging where the inner bag having large water vapor permeability was employed, conversion of the crystal form into β-form did not occur and the crystals packed therein were free flowing as before storage. On the contrary, the crystals packed in the inner bag having low water vapor permeability caked completely owing to the crystal conversion of α-form into β-form.

EXAMPLE 4

Crystals of L-lysine acetate (a product of Ajinomoto Co., Inc., loss on drying; 0.05% by weight) were packed under the conditions shown in Table 4 and storaged for 6 months while the temperature was left uncontrolled. Thereafter, the relation between the maximum relative humidity attained in the inner bag and the caking state of the crystals after the storage was examined

TABLE 4

<Packing conditions>

| Exp. No. | Water Vapor Permeability of Packaging Material ($g/m^2 \cdot 24$ hrs.) Outer Bag | Inner Bag | Ratio of Silica Gel to the Crystals (%) | Amount Packed of the Crystals (kg) |
|---|---|---|---|---|
| 1 | 2 | 7 | 1.2 | 50 |
| 2 | 2 | 470 | 1.2 | 50 |
| 3 | 2 | 1040 | 1.2 | 50 |
| 4 | 2 | 3100 | 1.2 | 50 |

The outer bag: silica coated PET/L-LDPE 85 μm in thickness (water vapor permeability 2 $g/m^2$.24 hrs.)

The inner bag:

Exp. No. 1: Low density polyethylene film 80 μm in thickness

Exp. No. 2: Complex film of "Cellpore WN-07" (15% of total area) and cast polypropylene (85% of total area; 50 μm in thickness)

Exp. No. 3: Complex film of "Cellpore WN-07" (33% of total area) and cast polypropylene (67% of total area; 50 μm in thickness)

Exp. No. 4: Perforated film "Cellpore WN-07" 170 μm in thickness

Figure 4:
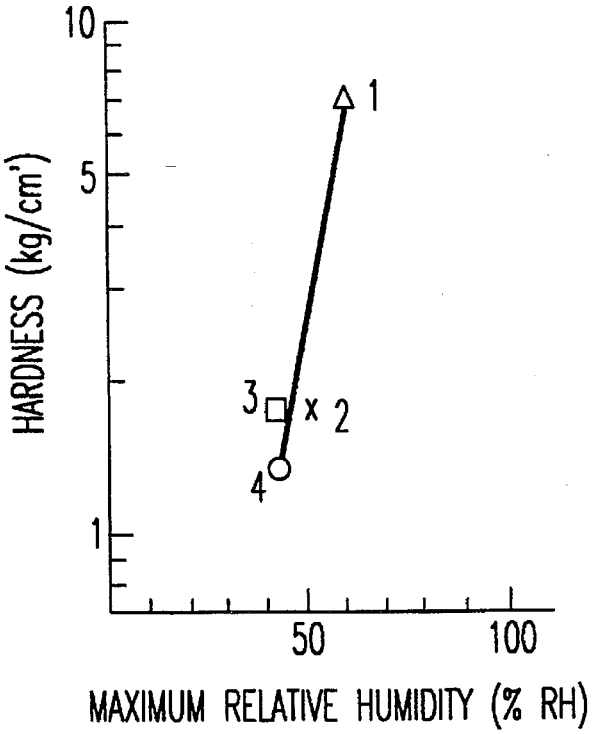
FIG. 4 is a graph showing a result of measurement of the relation between the maximum humidity attained in the inner bags and the hardness of the L-lysine acetate crystals stored for six months in using various inner bags having different water vapor permeabilities.

As a result, the relation between the maximum relative humidity attained in the inner bag and the hardness of the crystals representing the caking extent was as shown in FIG. 4. The crystals in Exp. No. 1 caked so that the total content in the inner bag became a hard lump. On the contrary, the crystals in Exp. Nos. 2, 3 and 4 did not cake at all and were free flowing as before storage. It is apparent that the caking inhibiting effect may be achieved by making the water vapor permeability of the inner bag greater and controlling the maximum relative humidity to be attained therein to lower level.

EXAMPLE 5

The dried and purified crystals of L-ornithine hydrochloride was packed in a bag under the conditions shown in Table 5 and storaged for 1.5 years while the temperature was left uncontrolled. Thereafter, the caking state of the crystals was estimated. The results were as shown in Table

TABLE 5

<Packing conditions>

| Exp. No. | Water Vapor Permeability of Packaging Material ($g/m^2 \cdot 24$ hrs.) Outer Bag | Inner Bag | Ratio of Silica Gel to the Crystals (%) | Amount Packed of the Crystals (kg) | Structure of an Inner Bag |
|---|---|---|---|---|---|
| 1 | 2 | 7 | 1 | 50 | LDPE only |
| 2 | 2 | 14700 | 1 | 50 | "Tyvek" only |
| 3 | 2 | 3700 | 1 | 50 | *1 |
| 4 | 2 | 7350 | 1 | 50 | *2 |
| 5 | 2 | 7350 | 1 | 50 | *3 |
| 6 | 2 | 7350 | 1 | 50 | *4 |

*1 A bag composed of combination of two kinds of packaging materials "Tyvek" (¼ of the total and (LDPE ¾ of the total) in the form of belt between the opening and the bottom parts, respectively.
*2 A bag composed of combination of two kinds of packaging materials, "Tyvek" (½ of the total) and LDPE (½ of the total) in the form of belt between the opening and the bottom parts, respectively.
*3 A bag composed of LDPE (½ of the total) in the upper half part and "Tyvek" in the lower half part.
*4 A bag composed of "Tyvek" (½ of the total) in the upper half part and LDPE in the lower half part.

* 1 A bag composed of combination of two kinds of packaging materials "Tyvek" (¼ of the total) and (LDPE ¾ of the total) in the form of belt between the opening and the bottom parts, respectively.
* 2 A bag composed of combination of two kinds of packaging materials, "Tyvek" (½ of the total) and LDPE (½ of the total) in the form of belt between the opening and the bottom parts, respectively.
* 3 A bag composed of LDPE (½ of the total) in the upper half part and "Tyvek" in the lower half part.
* 4 A bag composed of "Tyvek" (½ of the total) in the upper half part and LDPE in the lower half part.

An outer bag: silica coated PET/L-LDPE film having 85 μm in total thickness (water vapor permeability of 2 $g/m^2$.24 hrs.)

An inner bag:

Exp. No. 1: bag consisting of low density polyethylene (LDPE) film of 80 μm in thickness (water vapor permeability of 7 $g/m^2$.24 hrs.) only Exp. No. 2: bag consisting of "Tyvek" (a trade name, unwoven cloth made of high-density polyethylene (a product of Du Pont Company) (water vapor permeability of 14700 $g/m^2$.24 hrs.) only Exp. Nos. 3 to 6: bag composed of the combined "Tyvek" and LDPE (80 μm in thickness)

TABLE 6

<Caking state>

| Exp. No. | Hardness of the Crystals | The State of the Crystals Taken Out When the Inner Bag Opened After the Storage |
|---|---|---|
| 1 | 6.0 | *1 |
| 2 | 1.1 | *2 |
| 3 | 1.1 | *3 |
| 4 | 1.1 | *4 |
| 5 | 1.1 | *5 |
| 6 | 1.1 | *6 |

*1 Caked so that the total contents was a hard lump
*2 Uncaked and were free flowing as the starting time for storage
*3 Uncaked and were free flowing as a whole although a very small amount of extremely soft and fine blocks coexisted
*4 Uncaked and were free flowing as the starting time for storage
*5 Uncaked and were free flowing as a whole although a very small amount of extremely soft and fine blocks coexisted
*6 Uncaked and were free flowing as the starting time for storage It is apparent from Table 6 that the caking may be effectively inhibited by using an inner bag having large water vapor permeability and that the caking inhibiting effect may also be achieved even by using a packaging material having large water vapor permeability as a part of the inner bags.

There was proposed in the past a double packing bag composed of both an inner and an outer bags having low water vapor permeability, silica gel being placed between the inner and outer bags as the means to cope with the caking problem of powders or granules. As apparent from the present invention, the prior art package has no appreciable caking preventive effect. On the contrary, according to the double package of the present invention wherein the water vapor permeability of the inner package is large so that the maximum humidity to be attained in the inner package is controlled at lower level for a long term, the powders and granules having caking properties can be storaged for a long term of over six months, especially over one year without accompanying occurrence of caking.

We claim:

1. A storage container for hygroscopic powder or granular material, comprising:

a) an inner container having water vapor permeability of ≧400 $g/m^2$.24 hrs;

b) an outer container enclosing the inner container, wherein the outer container has no water vapor permeability or low water vapor permeability; and c) a desiccant between the inner container and the outer container.

2. A double package as claimed in claim 1 wherein either or both the inner and outer containers are in the shape of bag.

3. A double package as claimed in claim 1 wherein packaging article is powders or granules of an amino acid having caking property.

4. The storage container of claim 1, wherein the outer container is an aluminum foil laminated film.

5. The storage container of claim 1, wherein the inner container has a water vapor permeability of ≧1,500 $g/m^2$.24 hrs.

6. A process for packaging powder or granular material, comprising the steps of:

a) placing hygroscopic powder or granular material in an inner container having water vapor permeability of ≧400 $g/m^2$.24 hrs;

b) sealing the inner container;

c) enclosing the inner container in an outer container having no water vapor permeability or low water vapor permeability;

d) placing a desiccant between the inner container and the outer container; and e) sealing the outer container.

7. The process of claim 6, wherein the outer container is an aluminum foil laminated film.

8. The process of claim 6, wherein the inner container has a water vapor permeability of $\geqq 1{,}500$ g/m$^2$.24 hrs.

* * * * *